US007425105B2

(12) United States Patent
Grimes

(10) Patent No.: US 7,425,105 B2
(45) Date of Patent: Sep. 16, 2008

(54) OVERSIDE DRAIN SYSTEM FOR ROADWAYS AND LIKE SURFACE AREAS

(76) Inventor: Larry Eugene Grimes, 17638 Avenue 278, Exeter, CA (US) 93221

( * ) Notice: Subject to any disclaimer, the term of this patent is extended or adjusted under 35 U.S.C. 154(b) by 0 days.

(21) Appl. No.: 11/093,447

(22) Filed: Mar. 30, 2005

(65) Prior Publication Data

US 2006/0222458 A1 Oct. 5, 2006

(51) Int. Cl.
*E01C 11/22* (2006.01)

(52) U.S. Cl. ..... 404/2; 404/5

(58) Field of Classification Search ..... 404/2–5; 210/163–166; 405/39, 40, 42, 36, 41
See application file for complete search history.

(56) References Cited

U.S. PATENT DOCUMENTS

| | | | | | |
|---|---|---|---|---|---|
| 643,677 | A * | 2/1900 | Payne | 404/2 |
| 1,344,656 | A * | 6/1920 | Saltsman | 405/39 |
| 2,334,779 | A * | 11/1943 | Luff | 52/97 |
| 3,048,983 | A * | 8/1962 | Crummel | 405/119 |
| 3,410,094 | A * | 11/1968 | Shelley | 405/39 |
| 3,636,830 | A * | 1/1972 | Watts | 404/2 |
| 3,745,701 | A * | 7/1973 | Marvin | 47/33 |
| 3,872,676 | A * | 3/1975 | Nagao | 405/36 |
| 4,561,801 | A * | 12/1985 | Nantz | 405/15 |
| 5,015,122 | A * | 5/1991 | Combes | 405/36 |
| 5,267,367 | A * | 12/1993 | Wegmann, Jr. | 14/69.5 |
| 5,358,007 | A * | 10/1994 | Carlberg | 137/615 |
| 5,441,364 | A * | 8/1995 | Dressler | 405/119 |
| 5,645,367 | A * | 7/1997 | Gunter | 404/3 |
| 6,004,068 | A * | 12/1999 | Hosley | 405/118 |
| 6,394,700 | B1 * | 5/2002 | Fish | 405/124 |
| 6,409,427 | B1 * | 6/2002 | Maxwell, III | 405/39 |
| 6,797,162 | B2 * | 9/2004 | Happel | 210/163 |
| 6,805,517 | B2 * | 10/2004 | Chapek | 405/43 |
| 2003/0132150 | A1 * | 7/2003 | Happel | 210/163 |

FOREIGN PATENT DOCUMENTS

GB 2217364 A * 10/1989

* cited by examiner

*Primary Examiner*—Raymond W Addie
(74) *Attorney, Agent, or Firm*—Richard A. Ryan

(57) ABSTRACT

An overside drain system for use along roadways and other surface areas to drain fluids to a drainage area. The preferred spillway version comprises a premolded flare member to be placed adjacent the roadway, a premolded end cap member configured to drain fluids to the drainage area and premolded extension members disposed between the flare member and the end cap member to extend the drain to the drainage area. The flare member has a fluid entry section to receive fluids from the roadway and a fluid transfer section to transfer the fluids through the drain system. In the pipe or flume version of the overside drain system, the fluid transfer section comprises a pipe or flume member that connects to a piping or flume system. The various members can be made out of a recycled material, preferably crumb rubber. A filter can be used to remove contaminants from the fluid.

28 Claims, 6 Drawing Sheets

OVERSIDE DRAIN SYSTEM FOR ROADWAYS AND LIKE SURFACE AREAS

CROSS-REFERENCE TO RELATED APPLICATIONS

None.

BACKGROUND OF THE INVENTION

A. Field of the Invention

The field of the present invention relates generally to systems for transporting surface waters away from roads, highways and other surface areas. More particularly, the present invention relates to overside drain systems that are manufactured in premolded sections which are configured to be installed in place to facilitate a relatively consistent and cost effective roadside or slope drainage system. Even more particularly, the present invention relates to such drain systems that are made of materials which provide improved drainage installation, performance and life, particularly recycled materials such as crumb rubber.

B. Background

As is well known in the road construction and maintenance industry, most roads, highways and various other surface areas are constructed using paving machines that are adapted to put down extruded curbs alongside the roadway or surface. Overside drains, which are also known as slope drains, are openings that are installed along the roads, highways and other surface areas at the edges thereof to remove surface waters from the surface area in a manner that protects nearby slopes from drainage erosion. The typical overside drain consists of various combinations of pipes, flumes, lined ditches and the like that are placed at various intervals along the length of the roadway. The spacing, placement and configuration of overside drains depends on various factors, including the configuration of the ground, the highway profile, the anticipated quantity of flow and the limitations of flooding. These factors are generally considered by the engineers and respective governmental agencies during the design of the roadway. A typical spacing for overside drains is every 100 to 150 meters.

The most common material utilized for overside drains, as well as the curbs themselves, is asphalt concrete, which consists of asphalt and mineral aggregate mixed together. When used for paving roads, highways and parking lots, the asphalt concrete is laid down in a mat and then compacted. When used for overside drains, however, the asphalt material is placed in position by hand and then troweled into the desired shape. There are three standard types of overside drains that are commonly utilized and adopted by governmental agencies (such as the California Department of Transportation or Caltrans). These standard types are commonly known as pipe drains, flume drains and paved spillways. Pipe drains typically use metal or plastic pipe to convey drainage down the side slope. This type of drain is generally used where the side slope is at a slope ratio of one to four or steeper. Most commonly, the pipe is anchored to the ground with metal stakes or the like and the mouth or inlet pipe is set into place with ground and/or asphalt around the mouth/inlet being graded to accommodate an entrance taper. The entrance taper, also known as the paved gutter flare, is currently made with asphalt concrete, as is the whole area around the mouth of the pipe drain. Flume drains are similar to pipe drains, having a paved gutter flare and the entrance area shaped with asphalt concrete. The primary difference is that flume drains have a generally rectangular corrugated metal section and the drains are best adapted to side slopes having a slope ration of one to two or flatter. Paved spillways also have paved gutter flares and are generally made entirely from asphalt concrete. This type of drain is best used at slope ratios of approximately one to four or flatter. As with pipe and flume drains, the asphalt area of paved spillways are currently built by hand with asphalt rakes, shovels and hand trowels. The use of hand tools and manual labor in forming the appropriate drain configuration requires the resources of trained crews in order to obtain a consistent and proper drain. Because such crews are often not available, the asphalt drains are often not the quality desired. In addition, paved spillway drains require the ground below the drain to be graded in a generally v-shaped or similar configuration to act as a mold or form for the bottom half of the drain.

As is well known in the industry, problems with overside drains are commonly associated with the asphalt concrete portion of the drain. The process of spreading and shaping the asphalt concrete into drain or spillway shapes using hand tools often results in very inconsistent and dimensionally incorrect drains due to poor or uninformed workmanship. Because the asphalt concrete is difficult to compress or compact, it is placed at the drain in a generally loose or non-compacted state. Although the top or outer surface is typically slicked off with a trowel or other tool to provide a smooth finish, the asphalt concrete generally has little or no significant compaction strength. The overtopping of a drain due to flooding or other higher flow causes erosion concerns for the drain, such as eroding of the drain base and supporting ground below the spillway. This can cause the asphalt concrete to crack and/or break apart and possibly even move from its place or rest into areas outside of the highway or roadway right of way, where it can cause contamination and clean-up problems. Growth of grass, weeds and other vegetation through the non-compacted asphalt concrete and cracks therein can hasten the breaking apart of the asphalt concrete drain. The damage to the asphalt concrete drainage systems can require frequent, repeated repair and, at some point in time, replacement of the entire drain. Naturally, the need for repair or replacement of the drain can significantly increase the overall cost of the drain during its planned operational life.

The need for more roads and highways, with their associated overside drains, is a direct result of the increase in the number of cars, trucks and other vehicles using such roads and highways. The increase in vehicles results in an increase in the number of tires which are utilized with those vehicles. The replacement of the tires on the vehicles results in an ever increasing problem of used tire disposal. Every year millions of tires are placed in disposal sites. In fact, in the year 2000 approximately 270 million tires, which is equivalent to about five billion pounds of tires, were discarded. Most of these tires end up in land disposal sites where they tend to accumulate in tire piles. These tire piles are well known to cause environmental and health hazards for residents in nearby communities. For instance, rainwater can accumulate in these tire piles, creating a favorable environment for the development of mosquitoes, which are known to transmit diseases to humans and animals. Another major problem with these tire piles is their unfortunate tendency to catch fire. Tire fires can become quite massive and result in millions of dollars in costs to fight the fires and clean up the environmental mess left behind by thousands of melting tires spreading rubber and chemicals over the ground and into ground and surface waters. In addition, while the tires are burning the fire pumps significant quantities of pollutants into the air, directly affecting the health of those unfortunate enough to be living nearby or passing through the area.

Recognizing the problems associated with the disposal of used tires, a number of federal, state and local governmental agencies have committed resources towards finding viable alternatives to merely disposing of the tires into landfills and other storage areas. While a relatively small amount of tires are burned directly for fuel, the greatest potential to reduce the disposal problems associated with used tires is in the field of recycling. As is well known, however, some of the materials used for making tires safer and longer lasting, such as the embedded steel belts, polyester and other materials, make the recycling of tires more difficult. Perhaps the greatest potential for recycling tires is with a material commonly referred to as crumb rubber. There are two basic methods of producing crumb rubber from used tires. One process involves grinding the used tires at or near ambient temperature into successively smaller particles until the desired particle size is obtained. The other process is a cryogenic process that uses liquid nitrogen or other material to freeze tire chips or rubber particles prior to grinding in an impact-type reduction unit, such as a hammer mill. In either process, the tires are generally formed into a granular material that can be used directly as it is or as in ingredient in the manufacturing other composite materials. For instance, crumb rubber is used alone as a ground covering material for playgrounds and the like. Crumb rubber is also used as a modifier in a mix with asphalt for asphalt paving materials. Crumb rubber is also used for sidewalks (i.e., www.rubbersidewalks.com), sport tracks and other surface areas.

As set forth above, the presently available systems for installing overside drains has a number of limitations with regard to the asphalt material used for the drains and the need to have experienced personnel installing and overseeing the installation of the drains. Specifically, the use of non-compacted asphalt and the use of hand tools and spreading techniques results in substantial inconsistencies with regard to the quality, cost and durability of overside drains. As a result, the drains generally do not provide the appearance or service that is expected of overside drain systems. What is needed, therefore, is an improved overside drain system for roads and like surface areas that provides improved consistency of installation and improved operational service. The preferred overside drain system will provide overside drains that are generally uniform in size, shape and consistency by substantially reducing the dependency on the present manual labor techniques of installing such drains. The preferred overside drain system will utilize materials that are significantly less susceptible to the erosion and breaking apart that is commonly associated with the present asphalt construction. Even more preferably, an improved overside drain system will utilize recycled materials, such as crumb rubber and the like.

SUMMARY OF THE INVENTION

The overside drain system for roads, highways and like surface areas of the present invention provides the benefits and solves the problems identified above. That is to say, the present invention discloses an overside drain system that substantially improves the consistency and quality of overside drain installations while also providing improved operative characteristics for the overside drain. Specifically, the overside drain system of the present invention comprises a set of premolded, set-in-place components that are manufactured into preselected, uniform shapes and consistent forms and which are made out of materials selected for improved operation of the drain. The overside drain system provides improved aesthetics while reducing the likelihood that the drain will break apart or otherwise wash away. As such, the overside drain system of the present invention reduces the likelihood of repair costs and contamination of adjacent drainage areas. The premolded components of the overside drain system can be manufactured out of a variety of materials, including recycled materials such as crumb rubber and the like. Because the components of the overside drain system of the present invention are premolded, they require less labor and lower skilled labor to install and can generally be installed for a lower overall cost than is required for conventional overside drain systems. The present invention is adaptable for both new and retrofit overside drain systems.

In one general aspect of the present invention, the improved overside drain system for roads, highways and like surface areas, including parking lots and construction sites, of the present invention includes a set of premolded components, namely a flare member, one or more extension members and an end cap member that are interlockingly connected together to form the overside drain. In the preferred embodiment, the flare member has a fluid entry section at its first end and a fluid transfer section at its second end. The fluid entry section has a flare base and one or more generally upstanding flare sidewalls that are configured to generally direct fluids from the roadway or other surface area to the fluid transfer section. In the spillway version of the overside drain system, the fluid transfer section has a spillway base and a pair of spaced apart, generally upstanding spillway sidewalls that form a spillway channel therebetween. An extension member is placed substantially adjacent to the second end of the flare member to receive the fluid from the fluid transfer section. An end cap member, configured to drain the fluids to the drainage area, is placed at the opposite end of the extension member. If desired multiple extension members can be placed between the flare member and the end cap member in order to extend the drain to substantially near the desired drainage area. Preferably, the flare member, extension members and the end cap member are configured to interlockingly engage the adjacent members and a plurality of interlocking connectors, such as stakes, are utilized to connect the members together and secure the drain to the ground or other surface upon which it sits. In the preferred embodiment, flare member, end cap member and the one or more extension members of the overside drain system are made out of a recycled material such as crumb rubber, which will reduce the amount of used tires disposed into landfills and other storage areas. Other recycled materials may also be adaptable to the overside drain system of the present invention. In an alternative embodiment of the present invention, a filter is disposed in the flare member, extension member and/or end cap member components of the overside drain system to filter out oil, brake dust particles and other contaminants from the fluid before it reaches the drainage area. In another alternative embodiment of the present invention, no extension members are utilized such that the end cap member connects directly to the flare member. In another embodiment, the fluid transfer section comprises either a pipe member or a flume member that is substantially molded, attached or otherwise affixed to the flare member and configured to connect to either a piping or flume system to deliver the fluid to the drainage area.

Accordingly, the primary objective of the present invention is to provide an overside drain system for roads and like surface areas that provides the advantages discussed above and that overcomes the disadvantages and limitations associated with presently configured overside drain systems.

It is also an important objective of the present invention to provide an overside drain system for roads and like surface areas that comprises one or more premolded components that are made out of materials that are easier to install and which provide improved operating characteristics relative to presently configured asphalt concrete overside drains.

It is also an important objective of the present invention to provide an overside drain system for roads and like surface areas that comprises a selected set of premolded components which are made out of recycled materials such as crumb rubber and the like.

It is also an important objective of the present invention to provide an overside drain system for roads and like surface areas that includes a premolded flare member component having a fluid entry section with one or more side walls configured to direct fluids from a roadway or other surface into a fluid transfer section having a spillway, pipe or flume that is molded in, mounted on or affixed to the flare member so as to transfer fluids from the entry section to a specified drainage area.

It is also an important objective of the present invention to provide an overside drain system for roads and like surface areas comprising two or more premolded, interlocking members that are configured to be securely mounted to the ground or other surface to direct fluids from a surface area, such as a road or highway, to a drainage area.

It is also an important objective of the present invention to provide an overside drain system for roads and like surface areas having a flare component adapted to connect to an end of one or more extension members and a cap member adapted to connect to the opposite end of the one or more extension members.

It is also an important objective of the present invention to provide an overside drain system for roads and like surface areas that is configured to receive a filter mechanism that is adapted to remove oil and other contaminants from fluids passing through the drain system.

The above and other objectives of the present invention will be explained in greater detail by reference to the attached figures and the description of the preferred embodiment which follows. As set forth herein, the present invention resides in the novel features of form, construction, mode of operation and combination of components presently described and understood by the claims.

BRIEF DESCRIPTION OF THE DRAWINGS

In the drawings which illustrate the preferred embodiments and the best modes presently contemplated for carrying out the present invention.

DETAILED DESCRIPTION OF THE PREFERRED EMBODIMENTS

With reference to the figures where like elements have been given like numerical designations to facilitate the reader's understanding of the present invention, and particularly with reference to the embodiments of the overside drain system for roads and like surface areas of the present invention illustrated in the figures, various preferred embodiments of the present invention are set forth below. The enclosed description and drawings are merely illustrative of preferred embodiments and represent several different ways of configuring the present invention. Although specific components, materials, configurations and uses of the present invention are illustrated and set forth in this disclosure, it should be understood that a number of variations to the components and to the configuration of those components described herein and in the accompanying figures can be made without changing the scope and function of the invention set forth herein. For purposes of this disclosure, references are generally to use of the present invention alongside a road or highway, however, it is understood that the disclosure herein applies to other areas where it is necessary or desirable to drain water from a surface area (i.e., a parking lot or construction site).

Figure 1:
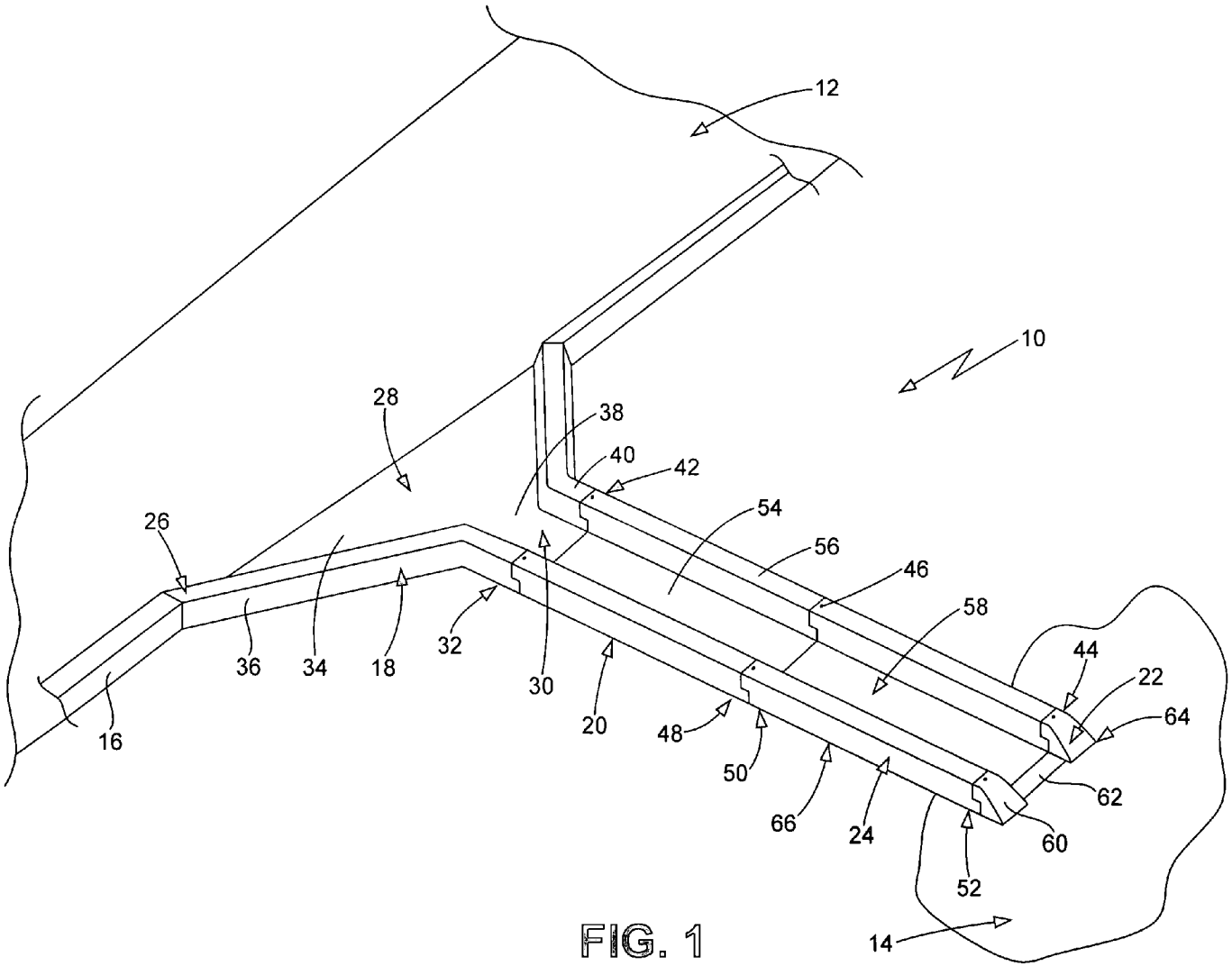
FIG. 1 is a top perspective view of a spillway configuration for a preferred embodiment of the overside drain system of the present invention showing the use of two extension members between the flare member and end cap member.

A preferred embodiment of an overside drain system that is manufactured out of the components and configured pursuant to the concepts and principles of the present invention is shown generally as 10 in the figures. As shown in FIG. 1, overside drain system 10 is configured to remove fluids from a surface area, such as the roadway or highway shown as 12, and transfer such fluids to a designated drainage area 14 located away from roadway 12. Typically, the fluids on roadway 12 to be removed will comprise rain water, creek/river overflow or other surface waters which are desired to be directed away from roadway 12 so as to improve the safety of those driving thereon. The typical roadway 12 has dikes or curbs 16 formed along the outer edge of the roadway 12 that, without an overside drain system such as that of the present invention, would otherwise tend to cause surface waters or other fluids to remain and accumulate on the roadway 12, presenting an obvious hazard to vehicle traffic using roadway 12. Typically, dikes 16 are formed of extruded asphalt concrete laid down by appropriately configured paving machines. The heretofore process of establishing an overside drain involves leaving open or cutting out a section of the extruded asphalt curb 16 to form an opening therein where laborers form the drain by spreading out asphalt that was dumped in the general area (typically unloaded from a truck by a skip loader or the like). The laborers form the drain into the desired configuration using hand tools, such as rakes and trowels. Although the asphalt is generally troweled to a smooth finish, the resulting overside drain has little or no compaction strength, which can cause the drain to crack or break apart. Less trained or motivated laborers can result in a lower quality drain that looks and performs poorly.

In a preferred embodiment of the overside drain 10 of the present invention, as shown in FIG. 1, the overside drain 10 comprises three or more interlocking modular components, including flare member 18, extension member 20 and end cap member 22. As shown, a second extension member 24 can be utilize to extend the length of overside drain 10 in order to reach the desired drainage area 14. As will be recognized by those skilled in the art, overside drain 10 of the present invention can be configured with one or more extension members 20 or it can be configured with no extension members 20, depending primarily on the distance between roadway 12 and drainage area 14. In the latter configuration, as set forth in more detail below and shown in FIG. 3, end cap member 22 attaches directly to flare member 18. In other configurations, also set forth below and shown in FIGS. 4 and 5, overside drain system 10 comprises just flare member 18.

Figure 2:
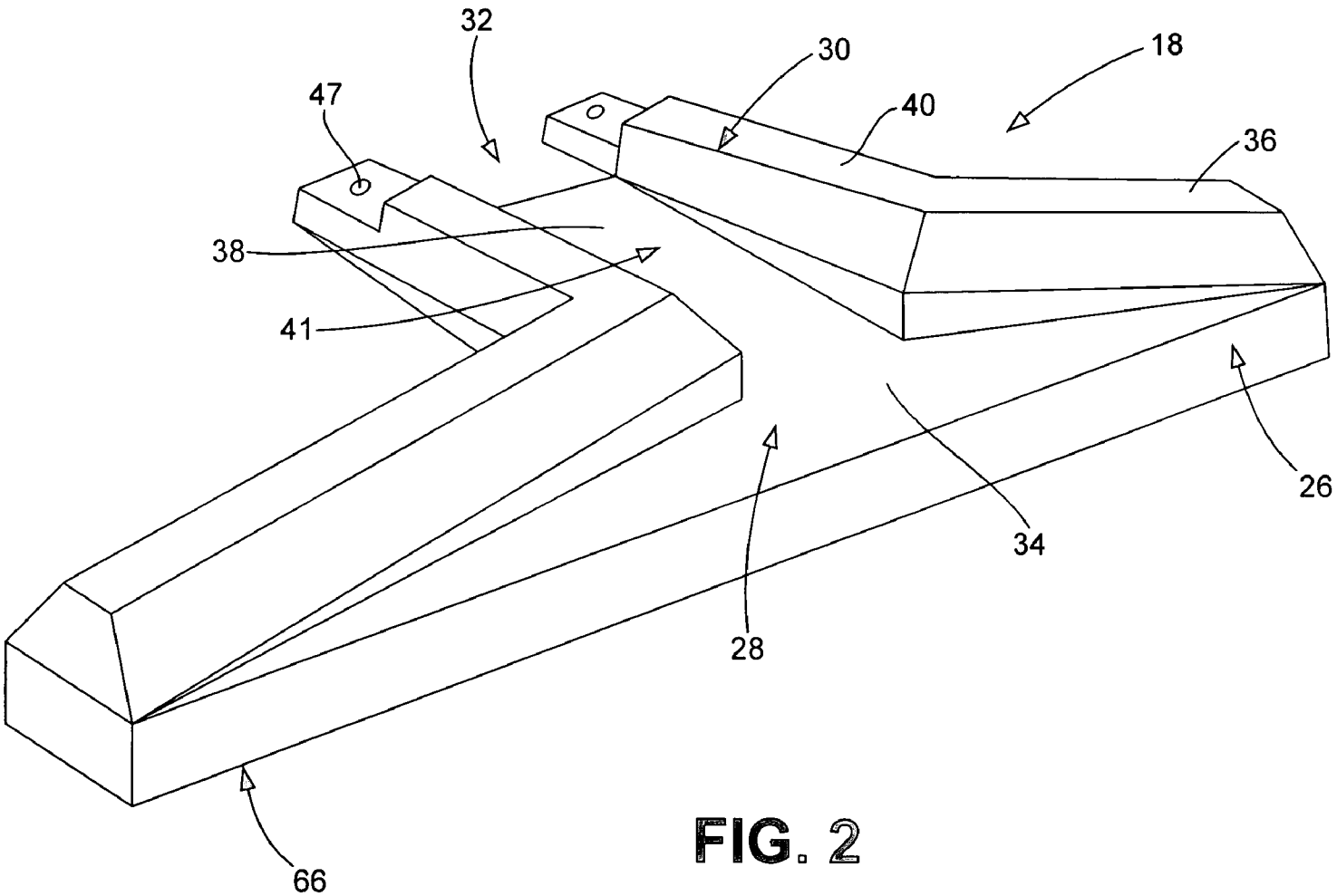
FIG. 2 is a roadway side perspective view of a flare member used for the spillway configuration of FIG. 1.

In any of the configurations for overside drain 10 of the present invention, the first end 26 of flare member 18 is adapted to be placed in a generally abutting relationship with roadway 12 at an opening disposed in the asphalt curb 16, as shown in FIG. 1. As shown in FIGS. 1 and 2, which is comparable in general configuration and use to the paved spillway type of overside drain of the prior art, flare member 18 has a fluid entry section 28 at first end 26 thereof for receiving fluids from roadway 12 and an adjacent fluid transfer section 30 at the second end 32 of flare member 18 for transferring the fluid from fluid entry section 28 toward drainage area 14. In the embodiment shown, fluid entry section 28 comprises a flare base 34 and one or more generally upstanding flare sidewalls 36 (two are shown in FIGS. 1 and 2). Although first end 26 of flare member 18 may be placed next to roadway 12 in a variety of different ways, in the preferred embodiment, flare sidewalls 36 at first end 26 are joined to curb 16 and flare base 34 is joined to roadway 12 using asphalt concrete or other appropriate material such that flare member 18 essentially becomes a part of roadway 12 and curbs 16.

Figure 3:
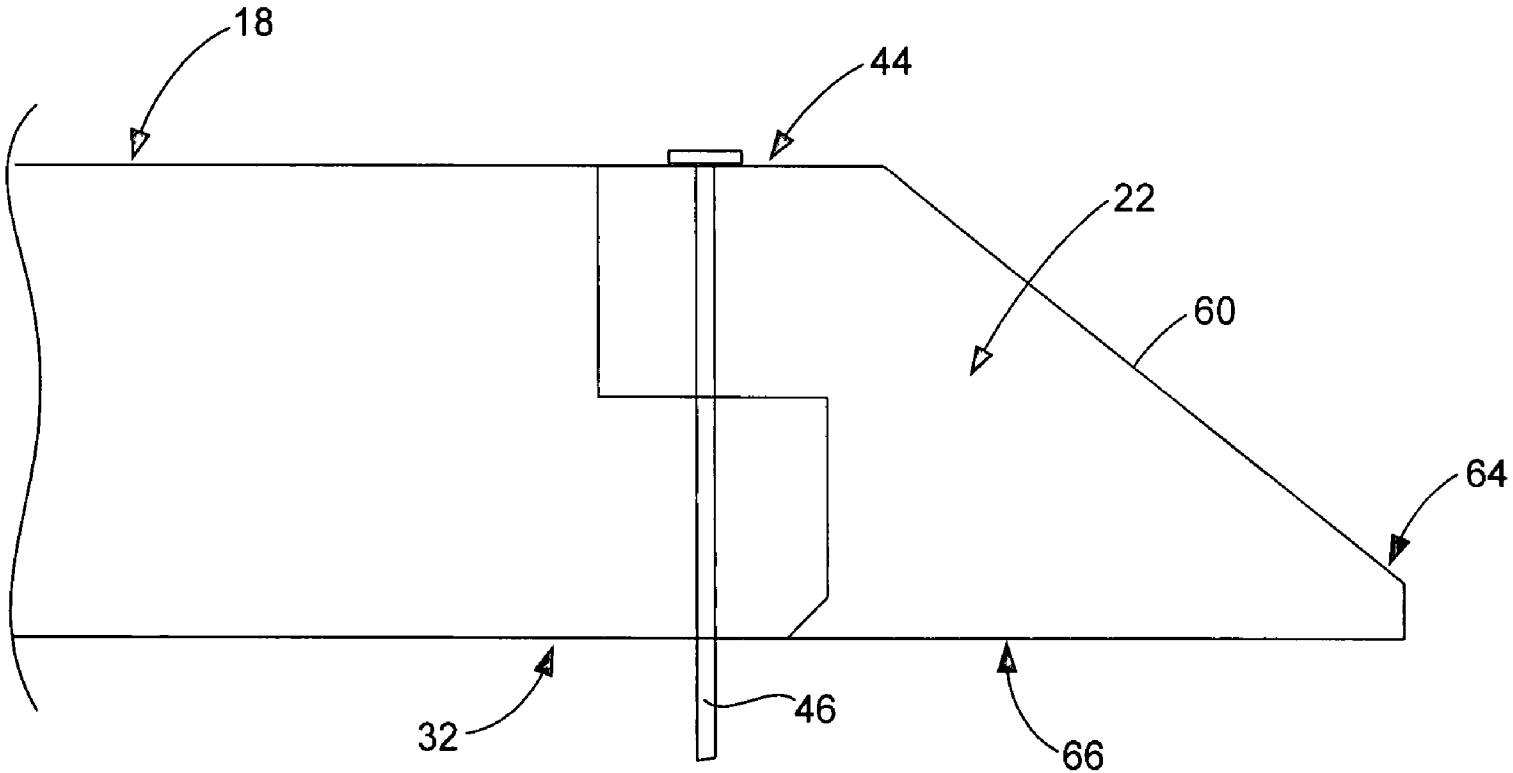
FIG. 3 is a side view of the interlocking connection between the flare member and end cap member of one embodiment of the overside drain system of the present invention.

In the spillway type of overside drain system 10 of the present invention shown in FIGS. 1 and 2, fluid transfer section 30 has a spillway base 38 bounded by a pair of spaced apart, generally upstanding spillway sidewalls 40 that form a substantially open spillway channel 41 therethrough. In one configuration, spillway channel 41 is approximately fourteen inches wide and ten inches long. The second end 32 of flare member 18 is provided with one-half of an interlocking connection, best shown in FIGS. 1 and 3, that is configured to be cooperatively engaged with the first end 42 of extension member 20 (as shown in FIG. 1) or first end 44 of end cap member 22 (as shown in FIG. 3) that are provided with the second half of the interlocking connection. While the second end 32 of flare member 18 and the first ends 42 and 44 of extension member 20 and end cap member 22 can be generally planar and placed in abutting relationship, the inventor of the present invention has found that utilizing an interlocking configuration similar to that shown in FIGS. 1 and 3 reduces the number of interlocking or engaging connectors, such as stake 46, needed to secure the members together, thereby reducing the cost and labor associated with installing the overside drain system 10. In addition, the use of interlocking connections is known to generally provide a more secure joining of two members than merely placing planar ends in abutting relationship. As will be recognized by those skilled in the art, various other types of interlocking configurations can be utilized in a likewise beneficial manner for overside drain system 10 of the present invention. In the interlocking configuration shown in the figures, stake 46 passes through a hole 47 in the interlocking members at second end 32 of flare member 18 and first end 42 of extension member 20 or first end 44 of end cap member 22 to substantially secure the members together and to secure them to the underlying surface (i.e., the ground below overside drain system 10). Stake 46, which can be made out of galvanized steel or other generally non-corrosive metal or material, is also used to connect the second end 48 of first extension member 20 to the first end 50 of second extension member 24 and the second end 52 of second extension member 24 to the first end 44 of end cap member 22, as shown in FIG. 1.

Extension members 20 and 24 are each configured with an extension base 54 and a pair of generally upstanding, spaced apart extension sidewalls 56 bounding extension base 54 to form a channel therebetween. Extension members 20 and 24 can be made of any length, be provided in different lengths and be configured to connect together to achieve the desired total length necessary for the distance between roadway 12 and drainage area 14. In some configurations, as shown in FIG. 3, no extension members 20 or 24 may be necessary. In other configurations, one, two or more extension members 20 and 24 may be necessary. In one configuration, the inventor utilizes an extension member 20 approximately thirty-six inches in length. The outside width of extension sidewalls 56 and the width of the channel formed therebetween is preferably configured to correspond to the dimensions of spillway sidewalls 40 and the channel formed with spillway base 38 so as to provide a generally contiguous channel, shown as 58 in FIG. 1, from fluid entry section 28 to end cap member 22. Although different sized channels can be utilized, doing so may increase the risk of separating the various members during heavy fluid flow conditions. A generally uniform channel 58 will provide a more through flow to drainage area 14. As set forth above and shown in FIG. 1, stakes 46 or other interlocking connecting devices are utilized to interlockingly connect first extension member 20 to second extension member 24 and likewise to any other extension members utilized in the overside drain system 10. Stakes 46 through the ends of the extension members 20 and 24 will also secure the members to the ground or other surface below.

The preferred embodiment of the overside drain system 10 of the present invention includes an end cap member 22 at the end thereof nearest where the fluid flows into drainage area 14. As shown in FIGS. 1 and 3, end cap member 22 has a pair of generally upstanding, spaced apart cap sidewalls 60 bounding cap base 62 and forming a channel therebetween. As with extension members 20 and 24, the outside width of cap sidewalls 60 and the width of the channel formed therebetween should be configured to correspond to the dimensions of channel 58 so as to continue the generally contiguous channel 58 from fluid entry section 28 to drainage area 14. As set forth above, the first end 44 of end cap member 22 should be configured to interlockingly engage the second end 32 of flare member 18 and/or second end 32 or 48 of either the first 20 or second 24 extension members, respectively, or any other extension member utilized between flare member 18 and end cap member 22. A stake 46 or other engaging device is used to attach end cap member 22 to flare member 18 or extension member 20 or 24 and to secure end cap member 22 to the ground or other surface below. Preferably, for ease of installation, the same type of stake 46 or other engaging device is used to connect the various members of overside drain system 10 In the preferred embodiment of the present invention, as shown in FIGS. 1 and 3, the cap sidewalls 60 and cap base 62 of end cap member 22 slope in a generally downward direction from first end 44 to the second end 64 of end cap member 22 to provide a smoother transition for the fluid flow to drainage area 14.

The flare member 18, extension members 20 and 24, and the end cap member 22 of the overside drain system 10 of the present invention are premolded to the desired size and shape. Preferably, the configuration of the various premolded members would be preselected so that standard form overside drains can be planned when designing a roadway or other surface. In this manner the members are formed utilizing molds and a material that is suitable for use in such molds. With premolded members, the installation of overside drain systems 10 can become more uniform, thereby further decreasing the costs and providing improved, consistent installations. A variety of different materials are suitable for use with the overside drain system 10 of the present invention.

The preferred materials are those that are adaptable for connection to a roadway or other surface and which are generally inert and, therefore, suitable for providing a relatively long and maintenance free life.

The preferred material for overside drain system 10 is the crumb rubber discussed above, which is made from recycled tires. Besides providing a generally durable, maintenance free overside drain system 10, the use of crumb rubber for this purpose can substantially reduce the amount of tires that are deposited in landfills and other disposal areas. The inventor has found the material to be quite suitable for molding into the desired shapes and adaptable for use with stakes or other interlocking connectors. In one method of making the various members, the inventor has utilized granular tire crumb (1 to 2 mm in size) from GreenMan Technologies out of Azusa, Calif. The granular tire crumb is mixed with an appropriate binder agent, such as Mistabond® H3007 a single component polyurethane MDI resin solution available from MarChem Corp. In a preferred mixture, approximately 9% of the resin solution by weight is mixed to a quantity of granular crumb rubber until the crumb rubber looks wet with the resin solution. At that time approximately ½% to 1% of by weight of water is added to accelerate the curing of the crumb rubber mixture. The mixture is poured into an open face mold in the desired shape (i.e., flare member 18, extension members 20 or 24, or end cap member 22) and then one or more steel plates are placed on top to force the mixture into the corners of the mold and squeeze the mixture together. After allowing to cure for approximately two hours, the steel plates are removed and the formed member is pulled from the mold. In this manner premolded overside drain members can be provided to a roadway or other surface area site for installation into overside drain system 10. Naturally, in mass production the actual manufacturing process may vary somewhat from that described herein.

The use of crumb rubber results in a generally inert drain system that, due to its size and configuration, utilizes a substantial amount of used tires. For example, in one configuration extension member 20 weighs approximately 125 lbs., utilizing over ten used tires that would otherwise be disposed of in a landfill or other disposal site. Depending on the size and configuration, flare member 18 uses between fifteen and thirty used tires. End cap member 22 typically utilizes between two and three used tires. A simple combination of a flare member 18, one extension member 20 and an end cap member 22 utilizes approximately twenty-seven to forty-three used tires. A drain required to extend approximately twenty-five feet to the drainage area 14 would use approximately one hundred used tires. One recent ten mile stretch of highway had approximately 450 drains. If these drains were to be configured according to the present invention and made of crumb rubber, approximately 25,000 to 30,000 used tires would be eliminated from disposal sites. As will be recognized by those skilled in the art, the use of crumb rubber for overside drain systems 10 configured according to the present invention will substantially reduce the amount of used tires being disposed, thereby reducing the problems associated therewith.

Various other advantages are associated with overside drain system 10 of the present invention, particularly when made from crumb rubber or similar materials. For instance, because the various members are staked to the ground and made into a consistent design, the system 10 configured as shown in FIG. 1 (the spillway design) can be used in areas having slopes steeper than the one to four ratio limit typically applicable to asphalt drains. In addition, if overtopping of the drain does occur the flowing fluid would not break apart the drain members and would not create the environmental problems associated with asphalt concrete drains. If overtopping disrupts the ground base below the drain members, the drain members could be removed and the area repaired and then the drain members reinstalled. This repair and reuse is not possible with an asphalt drain system. Another benefit arises when the roadway 12 is repaved or otherwise redone in a manner that changes the road level (typically raises it). If the road level is changed, the overside drain system 10 could be removed and reinstalled to match the new road level. If the drain system 10 is destroyed by traffic, it could be relatively easily removed and replaced. The flare member 18 can be made into various different sizes and configurations as may be desired for the particular roadway 12. Preferably, the bottom (shown as 66 in FIGS. 1 through 3) of all the drain members of drain system 10 is made to be generally planar to reduce the amount of ground preparation that is necessary prior to the installation of overside drain system 10 of the present invention. Unlike asphalt spillway drains, which require a v-shaped or similar configured base (ground) to act as a mold for the asphalt, the flat bottomed premolded drain members require significantly less ground preparation, which reduces the cost to install overside drain system 10. Because the premolded members are already at a finished appearance, the installation does not require skilled workmanship, as required for asphalt drains, to install, further reducing the cost of installation. From a long term perspective, a overside drain system 10 configured according to the present invention using crumb rubber material will likely have a much longer life than a similarly configured asphalt concrete drain. In addition, unlike asphalt drains which must be cleaned and have a sealant applied on a regular basis, overside drain system 10 would not need to be sealed. Overall, it is believed that an overside drain system 10 configured according to the present invention and made out of crumb rubber will provide a superior drain that is easier, cheaper and faster to install, that has a aesthetically pleasing appearance and which helps use a material that is otherwise a space, cost and environmental problem.

Figure 4:
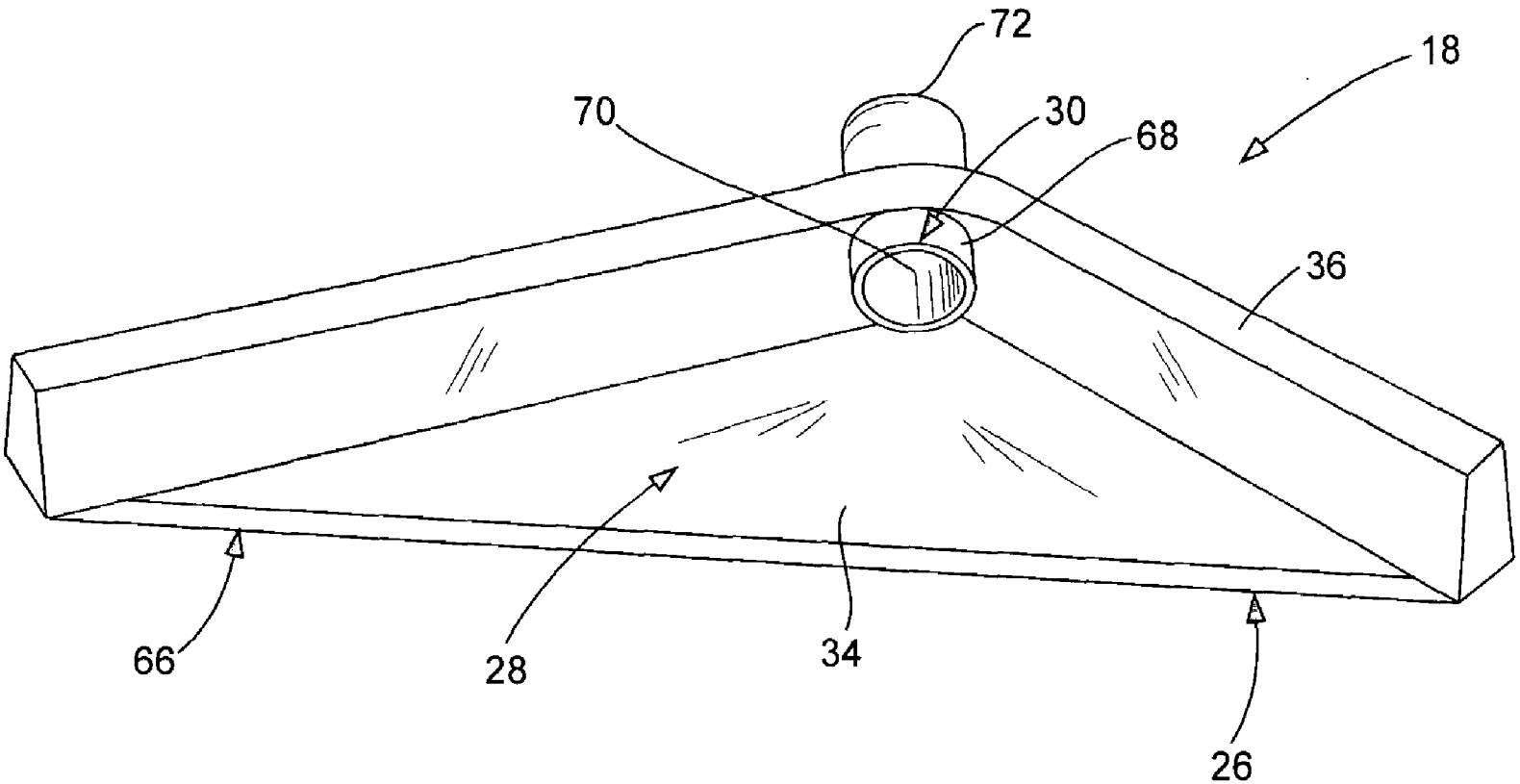
FIG. 4 is a perspective view of an alternative view of the flare member component of the overside drain system of the present invention configured as a pipe drain type of system.

In another configuration, shown in FIG. 4, flare member 18 is configured for the pipe drain type of overside drain system 10 that utilizes a pipe member 68, or other tubular member, as the fluid transfer section 30 to transfer water and other fluids from fluid entry section 28 to the drainage area 14. In a preferred embodiment, first end 70 of pipe member 68 is disposed in fluid communication with fluid entry section 28 at or very near the surface of flare base 34 so that flare sidewalls 36 will direct fluids toward first end 70 of pipe member 68. In the preferred embodiment of this configuration, second end 72 of pipe member 68 extends toward the second end 32 of flare member 18 to connect to additional pipe sections (not shown) as may be necessary to extend to drainage area 14. In the preferred embodiment, shown in FIG. 4, pipe member 68 is embedded or molded into flare member 18. In an alternative embodiment, not shown, pipe member 68 can be mounted in or affixed to flare member 18. For instance, flare member 18 can be configured as shown in FIG. 2 with spillway channel 41 sized and configured such that pipe member 68 substantially fills spillway channel 41 and is mounted onto or affixed to spillway base 38 using various mechanical connectors, adhesives or other mechanisms for securely attaching pipe member 68 to flare member 18. In another configuration, spillway channel 41 can be sized and configured such that pipe member 68 is effectively held in place by the spillway base 38 and spillway sidewalls 40 forming spillway channel 41. In another configuration, pipe member 68 can a tubular shaped opening in flare section 19 that is formed during the manufacturing of flare section 18. As with the spillway configuration discussed above, the flare section 18 for pipe member 68 is preferably made out of crumb rubber or other recycled materials and provides the various benefits discussed above, including consistency and uniformity of design and manufacturing.

Figure 5:
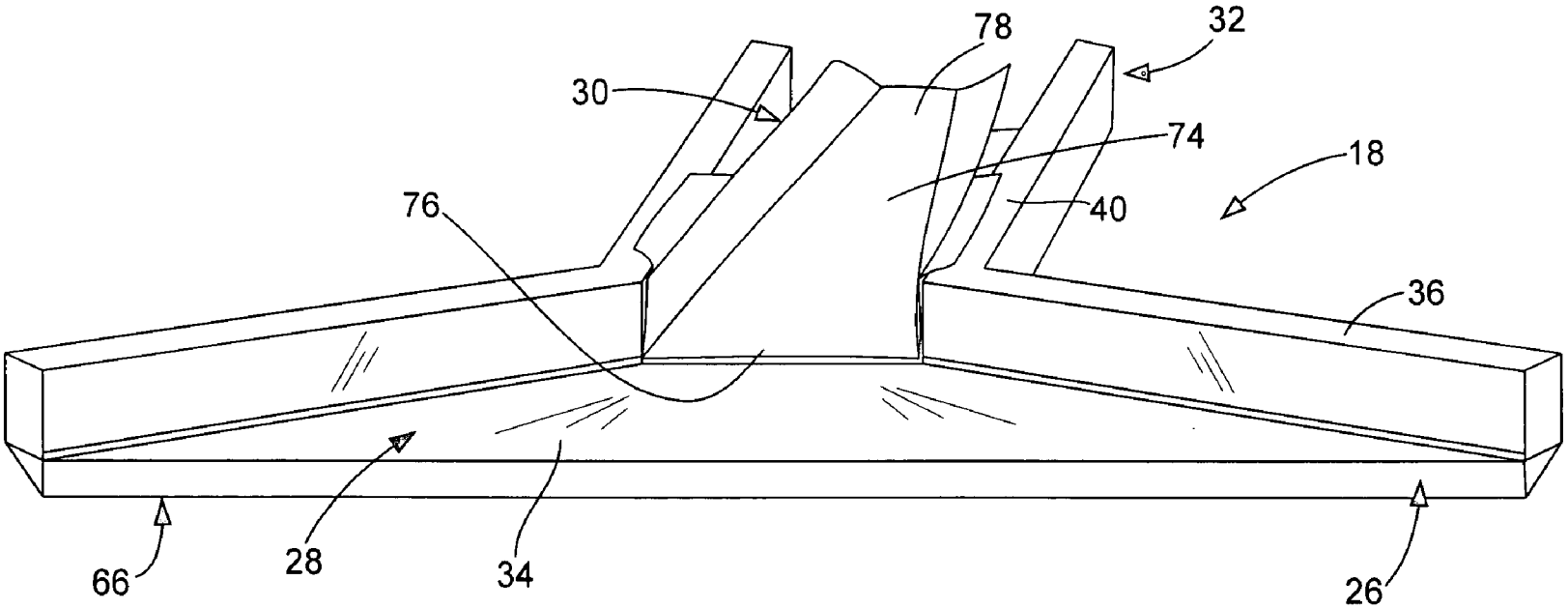
FIG. 5 is a perspective view of an alternative view of the flare member component of the overside drain system of the present invention configured as a flume drain type of system.

In yet another configuration of the present invention, shown in FIG. 5, flare member 18 is configured for the flume drain type of overside drain system 10 that utilizes a flume member 74 as the fluid transfer section 30 to transfer water and other fluids from fluid entry section 28 to the drainage area 14. In a preferred embodiment, first end 76 of flume member 74 is disposed in fluid communication with fluid entry section 28 at or very near the surface of flare base 34 so that flare sidewalls 36 will direct fluids toward first end 76 of flume member 74. In the preferred embodiment of this configuration, second end 78 of flume member 74 extends toward the second end 32 of flare member 18 to connect to additional flume sections (not shown) as may be necessary to extend to drainage area 14. As shown in FIG. 5, flume member 74 can narrow from the first end 76 to the second end 78 thereof. In the preferred embodiment, shown in FIG. 5, flume member 74 is molded into flare member 18. As shown, the basic configuration of flare member 18 can be approximately the same as that used for the spillway type of configuration shown in FIGS. 1 and 2 with flume member 74, which can be made out of metal, plastic, fiberglass, composite or other materials, included with the molding of flare member 18. In an alternative configuration, flume member 74 can be mounted in or affixed to flare member 18. For instance, flare member 18 can be configured as shown in FIG. 2 with spillway channel 41 sized and configured such that flume member 74 fits tightly in spillway channel 41 and is mounted onto or affixed to spillway base 38 using various mechanical connectors, adhesives or other mechanisms for securely attaching flume member 74 to flare member 18. In another configuration, spillway channel 41 is sized and configured such that flume member 74 is effectively held in place by the spillway base 38 and spillway sidewalls 40 forming spillway channel 41. As with the spillway configuration discussed above, the flare section 18 for flume member 74 is preferably made out of crumb rubber or other recycled materials and provides the various benefits discussed above, including consistency and uniformity of design and manufacturing.

Figure 6:
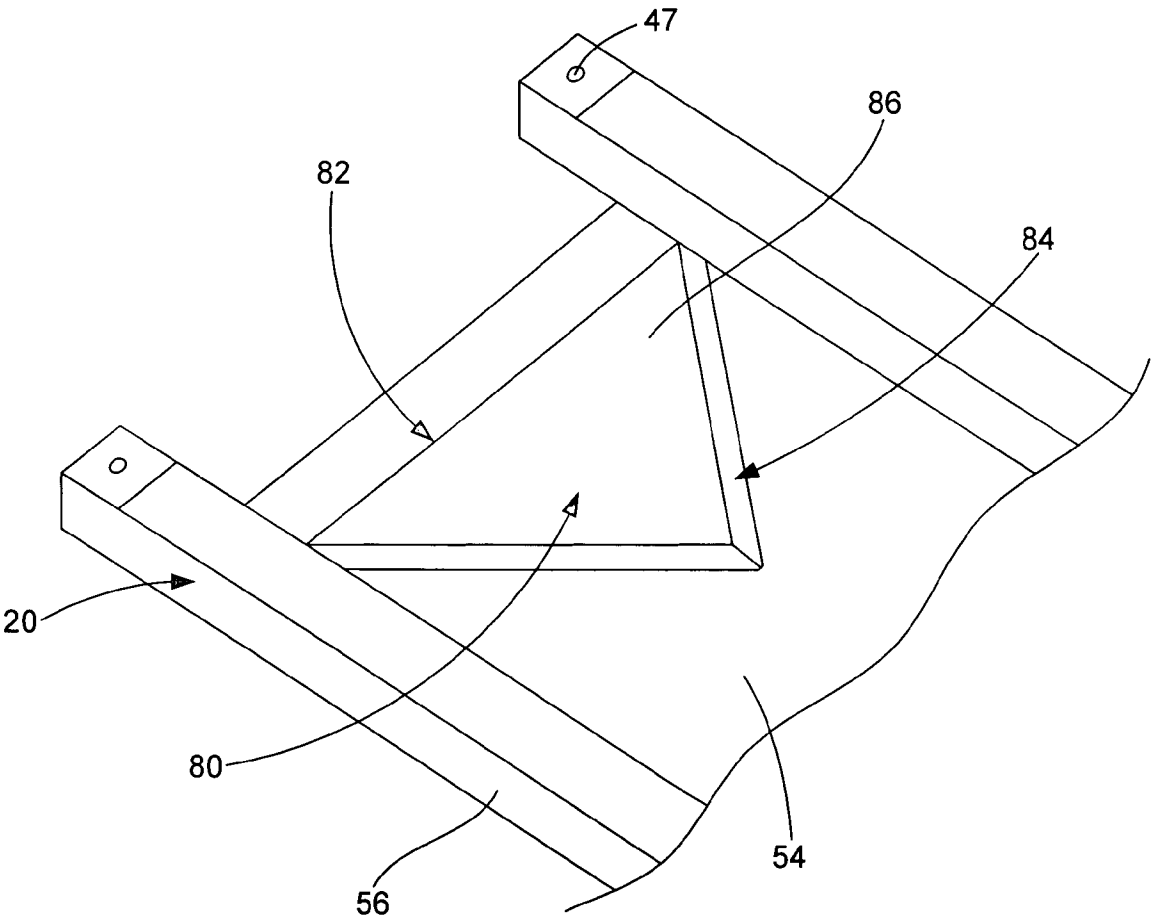
FIG. 6 is a top perspective view of an extension member for the overside drain system of the present invention showing the use of a filter therein.

In yet another alternative configuration of the overside drain system 10 of the present invention, a filter 80 is included to remove oil, brake dust particles and other contaminants from the fluid flowing through the drain system, as shown in FIG. 6. In the embodiment shown in FIG. 6, filter 80 is included with extension member 20 and placed in the channel formed by extension base 54 and extension sidewalls 56. Alternatively, one or more filters 80 can be placed in contiguous channel 58 at flare member 18, second extension member 24 and/or end cap member 22. In one configuration, filter 80 has an inlet screen 82 and outlet screens 84 configured to allow fluid to pass therethrough while being filtered by a filter element (not shown) disposed inside filter 80. In a preferred embodiment, filter 80 includes the ability to replace the filter element as necessary or needed to provide the desired filtering ability. The ability to remove/replace filter element can be accomplished by providing a hinged, openable filter lid 86 that can be raised to provide access to the filter element therein for cleaning or replacement thereof. Alternatively, filter 80 can be configured as a solid filter that is itself cleaned or replaced when necessary or desired. In either configuration, it is preferred that filter 80 be sized and configured that if filter 80 (i.e., inlet screen 82 and/or outlet screen 84) becomes plugged with contaminants or debris, the fluid will flow over the top of filter 80 and continue down the channel and not flow over the sidewalls of the particular component. This objective can be accomplished by the triangular configuration shown and/or by utilizing a filter 80 that is lower than the respective sidewalls.

In use, the premolded members flare member 18, extension member 20, second extension member 24 and end cap member 22 are manufactured as described above, preferably out of a recycled material such as crumb rubber or the like. In the preferred embodiment, the members are configured to interlockingly connect to form a substantially integral drain that interconnects roadway 12 with drainage area 14. Stakes 46 or other interlocking connectors are used to connect the various members together to form drain 10 and substantially affix the drain members to the ground or other surface upon which it rests. Because the bottom 66 of the members is substantially planar, the amount of ground site preparation necessary to install overside drain system 10 is much less than required for conventional asphalt concrete drains. Having premolded members provides the advantage of having consistent quality and configuration for delivery to the site where the overside drain system 10 is needed. In addition, the size and configuration of the various members can be preselected so as to reduce the cost of manufacturing and provide easier and quicker installation. To install, the overside drain system 10, the user merely selects which type of drain system (i.e., the spillway, pipe or flume design) is desired and then mounts the flare member 18 next to the roadway 12. In one method, flare member 18 is fixed into by position by using the asphalt concrete that is part of the curb 16 to attach to flare sidewalls 36 such that flare base 34 is substantially adjacent to roadway 12. Once flare member 18 is in place, the remaining part of the drain system is put into place. In the spillway version, either end cap member 22 is attached to second end 32 of flare member 18 or one or more extension members 20 and 24 are installed between flare member 18 and end cap member 22. In the preferred embodiment, the various members are interlockingly connected together and held in place by stakes 64 (as described above). In the pipe or flume versions, the second end 72 of pipe member 68 is connected to additional pipe sections or second end 78 of flume member 74 is connected to additional flume sections so as to extend the drain to drainage area 14. Once installed, overside drain system 10 provides a more durable and effective drain system, particularly when made out of a material such as crumb rubber. The use of crumb rubber will also reduce the amount of tires stored in landfills and other storage areas. As necessary or desirable, the overside drain system 10 of the present invention can be removed to repair the ground underneath or for use elsewhere, unlike the current asphalt concrete types of drain systems.

While there are shown and described herein certain specific alternative forms of the invention, it will be readily apparent to those skilled in the art that the invention is not so limited, but is susceptible to various modifications and rearrangements in design and materials without departing from the spirit and scope of the invention. In particular, it should be noted that the present invention is subject to modification with regard to the dimensional relationships set forth herein and modifications in assembly, materials, size, shape, and use. For instance, there are numerous components described herein that can be replaced with equivalent functioning components to accomplish the objectives of the present invention.

What is claimed is:

1. An overside drain system for directing fluids from a roadway to a drainage area, said overside drain system comprising a premolded flare member having a fluid entry section at a first end of said flare member and a fluid transfer section at a second end of said flare member, said fluid entry section having a flare base and one or more generally upstanding flare sidewalls, wherein said flare sidewalls are configured to substantially direct the fluids from said roadway towards said fluid transfer section and said fluid transfer section is configured to direct said fluids to said drainage area, wherein said first end of said flare member is wider than said second end of said flare member, and said fluid transfer section comprises a spillway base and two spaced apart, generally upstanding spillway sidewalls, said spillway base and spillway sidewalls forming a spillway channel therebetween.

2. The overside drain system according to claim 1, wherein said flare member is made out of a recycled material.

3. The overside drain system according to claim 2, wherein said recycled material is crumb rubber.

4. The overside drain system according to claim 1 further comprising an end cap member positioned substantially adjacent to said second end of said flare member, said end cap member having a cap base and opposing side walls forming a channel substantially contiguous with said spillway channel to drain the fluids to said drainage area.

5. The overside drain system according to claim 4, wherein said flare member and said end cap member are configured to be interlockingly joined together.

6. The overside drain system according to claim 1, wherein said first end of said flare member is disposed in generally abutting relationship with the roadway.

7. The overside drain system according to claim 1 further comprising an extension member and an end cap member, said extension member positioned substantially adjacent said second end of said flare member and disposed between said flare member and said end cap member.

8. The overside drain system according to claim 7, wherein said flare member, said extension member and said end cap member define a contiguous channel from said fluid entry section to said drainage area.

9. The overside drain system according to claim 7, wherein a first end of said extension member is configured to be interlockingly joined to said second end of said flare member and a first end of said end cap member is configured to be interlockingly joined to a second end of said extension member.

10. The overside drain system according to claim 7 further comprising a filter disposed in at least one of said flare member, said extension member and said end cap member.

11. The overside drain system according to claim 7, wherein said flare member is made out of a recycled material.

12. The overside drain system according to claim 11, wherein said recycled material is crumb rubber.

13. The overside drain system according to claim 1 further comprising a filter disposed in said flare member.

14. The overside drain system according to claim 1, wherein said fluid transfer section comprises either a pipe member or a flume member molded in, mounted on or affixed to said flare member.

15. The overside drain system according to claim 14, wherein said flare member is made out of a recycled material.

16. The overside drain system according to claim 15, wherein said recycled material is crumb rubber.

17. An overside drain system for directing fluids from a roadway to a drainage area, said overside drain system comprising:

a premolded flare member having a fluid entry section at a first end of said flare member and a fluid transfer section at a second end of said flare member, said fluid entry section having a flare base and one or more generally upstanding flare sidewalls; and an end cap member positioned adjacent to said second end of said flare member, said end cap member configured to drain the fluids to said drainage area, wherein said flare sidewalls are configured to substantially direct the fluids from said roadway towards said fluid transfer section and said fluid transfer section is configured to direct the fluids to said end cap member and toward said drainage area, wherein said first end of said flare member is wider than said second end of said flare member, and said fluid transfer section comprises a spillway base and two spaced apart, generally upstanding spillway sidewalls, said spillway base and spillway sidewalls forming a spillway channel therebetween.

18. The overside drain system according to claim 17 further comprising an extension member positioned substantially adjacent said second end of said flare member and disposed between said flare member and said end cap member.

19. The overside drain system according to claim 18, wherein a first end of said extension member is configured to be interlockingly joined to said second end of said flare member and a first end of said end cap member is configured to be interlockingly joined to a second end of said extension member.

20. The overside drain system according to claim 17, wherein said first end of said flare member is disposed in generally abutting relationship with the roadway.

21. The overside drain system according to claim 17, wherein said flare member and said end cap member are made out of a recycled material.

22. The overside drain system according to claim 21, wherein said recycled material is crumb rubber.

23. The overside drain system according to claim 17 further comprising a filter disposed in at least one of said flare member and said end cap member.

24. An overside drain system for directing fluids from a roadway to a drainage area, said overside drain system comprising:

a premolded flare member having a fluid entry section at a first end of said flare member and a fluid transfer section at a second end of said flare member, said fluid entry section having a flare base and one or more generally upstanding flare sidewalls, said fluid transfer section having a spillway base and two spaced apart, generally upstanding spillway sidewalls, said spillway base and said spillway sidewalls forming a spillway channel therebetween;

an end cap member, said end cap member configured to drain the fluids to said drainage area; and one or more extension members disposed between said flare member and said end cap member, wherein said flare sidewalls are configured to substantially direct the fluids from said roadway towards said fluid transfer section and said fluid transfer section is configured to direct the fluids through said one or more extension members to said end cap member and toward said drainage area, wherein said first end of said flare member is wider than said second end of said flare member, and said fluid transfer section comprises a spillway base and two spaced apart, generally upstanding spillway sidewalls, said spillway base and spillway sidewalls forming a spillway channel therebetween.

25. The overside drain system according to claim 24, wherein said flare member, said end cap member and/or said one or more extension members are made out of a recycled material.

26. The overside drain system according to claim 25, wherein said recycled material is crumb rubber.

27. The overside drain system according to claim 24 further comprising a filter disposed in at least one of said flare member, said extension member and said end cap member.

28. The overside drain system according to claim 6, wherein said flare sidewalls at said first end of said flare member are substantially joined to a curb generally adjacent the roadway.

* * * * *